US010030868B2

(12) United States Patent
Nakatani et al.

(10) Patent No.: US 10,030,868 B2
(45) Date of Patent: Jul. 24, 2018

(54) PREMIXING APPARATUS

(71) Applicant: Rinnai Corporation, Nagoya-shi, Aichi (JP)

(72) Inventors: Tatsuyoshi Nakatani, Nagoya (JP); Mitsuru Uozaki, Nagoya (JP)

(73) Assignee: RINNAI CORPORATION, Nagoya-shi, Aichi (JP)

( * ) Notice: Subject to any disclaimer, the term of this patent is extended or adjusted under 35 U.S.C. 154(b) by 395 days.

(21) Appl. No.: 14/711,950

(22) Filed: May 14, 2015

(65) Prior Publication Data

US 2015/0354810 A1 Dec. 10, 2015

(30) Foreign Application Priority Data

Jun. 4, 2014 (JP) ..... 2014-115590

(51) Int. Cl.
*F23D 14/62* (2006.01)
*F23D 14/34* (2006.01)

(52) U.S. Cl.
CPC ..... *F23D 14/62* (2013.01); *F23D 14/34* (2013.01)

(58) Field of Classification Search
CPC ..... F23D 14/62; F23D 14/34; F23D 14/04; F23N 1/027; F23N 1/025
See application file for complete search history.

(56) References Cited

U.S. PATENT DOCUMENTS

2013/0294192 A1 11/2013 Son

FOREIGN PATENT DOCUMENTS

| | | | | |
|---|---|---|---|---|
| DE | 19729047 C1 * | 9/1998 | ..... | F23D 14/62 |
| EP | 0 846 916 A2 | 6/1998 | | |
| JP | S52-112830 A | 9/1977 | | |
| JP | S52-140928 A | 11/1977 | | |
| JP | 53-48227 U | 4/1978 | | |
| JP | S54-79833 A | 6/1979 | | |
| JP | S54-131869 U | 9/1979 | | |
| JP | 54-137732 A | 10/1979 | | |
| JP | 2014-502719 A | 2/2014 | | |
| WO | 02/29319 A1 | 4/2002 | | |
| WO | 2013/129775 A1 | 9/2013 | | |

OTHER PUBLICATIONS

Nagaoka English translation.*

(Continued)

*Primary Examiner* — Jason Lau
(74) *Attorney, Agent, or Firm* — Westerman, Hattori, Daniels & Adrian, LLP

(57) ABSTRACT

A premixing apparatus for mixing a fuel gas with air has an air resistance changeover device for changing over a flow resistance in the air feed passage and a gas resistance changeover device for changing over a flow resistance in the gas feed passage. The air resistance changeover device includes a venturi portion provided in that part of the air feed passage which is on a downstream side of the butterfly valve. A gas chamber is provided in that part of the gas feed passage which is on a downstream side of the gas resistance changeover device. A gas suction portion is configured such that the fuel gas is sucked from the gas chamber into an entire circumference of that part of the air feed passage which is adjacent to a downstream side of the venturi portion.

1 Claim, 4 Drawing Sheets

(56) References Cited

OTHER PUBLICATIONS

Office Action dated Mar. 7, 2017, issued in counterpart Japanese Patent Application No. 2014-115590, with English translation. (8 pages).
Office Action dated Nov. 1, 2016, issued in counterpart Japanese Patent Application No. 2014-115590, with English translation. (6 pages).
Office Action dated Jun. 28, 2016, issued in counterpart Japanese Patent Application No. 2014-115590. (3 pages).

* cited by examiner

PREMIXING APPARATUS

BACKGROUND OF THE INVENTION

1. Field of the Invention

The present invention relates to a premixing apparatus for mixing a fuel gas with air to supply a fuel-air mixture through a fan to a burner.

2. Background of the Related Art

As this kind of premixing apparatus, there is known the following art in Tokkyo Kohyo Koho (National Publication of Translated Version) No. 2014-502719. In the known premixing apparatus, a downstream side of a gas feed passage, in which is interposed a flow control valve for supplying a fuel gas, is connected to an air feed passage on an upstream side of the fan. The premixing apparatus comprises: an air resistance changeover means for changing over, between high and low, a flow resistance in the air feed passage; and a gas resistance changeover means for changing over, between high and low, a flow resistance in that part of the gas feed passage which is on a downstream side of the flow control valve (note: the expression of "that part of . . . which is . . . " means "such a part of . . . as is . . . "; namely, the last part of the above sentence partially means "a flow resistance in such a part of the gas feed passage as is on a downstream side of the flow control valve").

By the way, when a proportional valve is used as a flow control valve, control is made of the proportional valve such that the fuel gas depending on the required amount of combustion can be supplied. Further, control is made of the number of fan revolution depending on the required amount of combustion such that a fuel-air ratio of a fuel-air mixture to be supplied to the burner becomes constant. However, in case the required amount of combustion falls below a predetermined amount and, as a result, the number of fan revolution falls below a lower limit value of fan revolution at which the proportional characteristics of the air feed amount can be maintained, or in case the proportional valve current (electric current charge to the proportional valve) falls below the lower-limit current at which the proportional characteristics of the gas feed amount can be maintained, the air or fuel gas depending on the required amount of combustion can no longer be supplied.

Further, there is a case in which, as the flow control valve, a zero governor is used to maintain the secondary gas pressure at the atmospheric pressure. In this case, the gas feed amount varies with the differential pressure between the atmospheric pressure which is the secondary gas pressure and the negative pressure in the air feed passage. And since the negative pressure in the air feed passage varies with the number of fan revolution, the fuel gas feed amount varies with the number of fan revolution, i.e., the air feed amount. Therefore, by controlling the number of fan revolution depending on the required amount of combustion, the amount of air and fuel gas depending on the required amount of combustion will be supplied to the burner.

In this arrangement, too, when the number of fan revolution falls below the lower-limit revolution at which the proportional characteristics of the air feed amount can be maintained, the amount of air or fuel gas depending on the required amount of combustion can no longer be supplied. Therefore, when the required amount of combustion has fallen below a predetermined amount, the following becomes necessary. In other words, by increasing the flow resistance in the air feed passage by means of the air resistance changeover means without decreasing the number of fan revolution below the above-described lower limit value, the air depending on the amount of required combustion below the predetermined value must be supplied. In addition, only by increasing the flow resistance in the air feed passage will result in that, due to an increase in the negative pressure in the air feed passage, the fuel gas feed amount will exceed the amount depending on the required combustion amount. It is therefore necessary to increase also the flow resistance in the gas feed passage to suit an increase in the flow resistance in the air feed passage.

To comply with the above, the above-described known art has the following arrangement. In other words, when the required combustion amount has fallen below a predetermined value, the flow resistance in the air feed passage can be increased by the air resistance changeover means and, at the same time, the flow resistance in the gas feed passage is increased by the gas resistance changeover means so that air or fuel gas in an amount depending on the required amount of combustion below the predetermined value can be supplied.

In the above-described known art, the following arrangement is employed. In other words, the air feed passage is once branched into two, i.e., the first and the second, air passages on the way and they are merged. The merged portion is provided with a valve seat having formed therein an opening which allows for flow of air from the first air flow passage. Air resistance changeover means is constituted by a valve which closes the opening by seating on the valve seat. It is thus so arranged that, by closing the opening, the flow resistance in the air feed passage becomes larger. In addition, a downstream end of the gas feed passage is branched into two branch passages connected to the second air feed passage. A valve that opens and closes the connection port of one of the branched passages relative to the air feed passage constitutes the gas resistance changeover means. It is thus so arranged that, by closing the connection port, the flow resistance in the gas feed passage increases.

This arrangement, however, has a problem in that, in case the flow resistance in the air feed passage is increased, the air is caused to flow only in the second air feed passage and, therefore, that the negative pressure is not generated so much. As a result, the suction force of the fuel gas becomes weaker, so that stable gas introduction becomes difficult. In addition, in case the air flows also in the first air feed passage to thereby decrease the flow resistance in the air feed passage, the fuel gas is introduced into the second air flow passage. As a result, the fuel gas does not successfully get mixed with the air that has been introduced into the first air flow passage, resulting in an uneven distribution of fuel-air ratio.

SUMMARY

Problems that the Invention is to Solve

In view of the above-mentioned problems, this invention has an advantage of providing a premixing apparatus which is capable of stably introducing a fuel gas also at the time when the flow resistance in the air feed passage is increased, and which is also capable of preventing the occurrence of uneven distribution of fuel-air ratio of the fuel-air mixture.

Means for Solving the Problems

In order to solve the above-mentioned problems, this invention is a premixing apparatus for mixing a fuel gas with air to supply a fuel-air mixture to a burner through a fan, in which a downstream end of a gas feed passage having interposed therein a flow control valve for supplying the fuel gas is connected to an air feed passage on an upstream side of the fan. The premixing apparatus comprises: an air resistance changeover means for changing over, between high and low, a flow resistance in the air feed passage; and a gas resistance changeover means for changing over, between high and low, a flow resistance in that part of the gas feed passage which is on a downstream side of the flow control valve. The air resistance changeover means is constituted by a butterfly valve rotatably disposed in the air feed passage. A venturi portion is provided in that part of the air feed passage which is on a downstream side of the butterfly valve. The venturi portion is coaxial with that another part of the air feed passage which is provided with the butterfly valve and is smaller in cross sectional area than said another part of the air feed passage. A gas chamber is provided in that part of the gas feed passage which is on a downstream side of the gas resistance changeover means, the gas chamber enclosing an entire circumference of the venturi portion, and a gas suction portion is provided to suck the fuel gas from the gas chamber into that part of the air feed passage which is adjacent to a downstream side of the venturi portion. The gas suction portion is so constructed and arranged that the fuel gas is sucked into an entire circumference of that part of the air feed passage which is adjacent to the downstream side of the venturi portion.

According to this invention, the flow velocity of the air increases at the venturi portion, thereby giving rise to a negative pressure. Therefore, also at the time when the butterfly valve is rotated to a posture at right angles to the longitudinal direction of the air feed passage, thereby increasing the flow resistance in the air feed passage, the fuel gas can be sucked stably from the gas suction portion. Further, since the venturi portion is coaxial with that portion of the air feed passage which is provided with the butterfly valve, negative pressure is generated uniformly over the entire circumference of the venturi portion. Due to this negative pressure, the fuel gas is sucked from the gas suction portion into an entire circumference of that part of the air feed passage which is adjacent to the downstream side of the venturi portion. As a result, the occurrence of uneven distribution of fuel-air ratio of the fuel-air mixture can be prevented.

In addition, according to this invention, that cross sectional shape of the butterfly valve which is at right angles to the axis of rotation of the butterfly valve shall preferably be a diamond. According to this arrangement, when the butterfly valve is moved into a posture at right angles to the longitudinal direction of the air feed passage, due to the inclination of that surface of the butterfly valve which faces the upstream side of the air feed passage, the air is guided to flow along the circumferential wall surface of the venturi portion. As a consequence, the flow velocity of the air becomes the highest in the neighborhood of the circumferential surface of the venturi portion, and the negative pressure operating on the gas suction portion increases. Therefore, the stability in suction of the fuel gas from the gas suction portion is further improved at the time when the flow resistance in the air feed passage is increased.

DESCRIPTION OF THE PREFERRED EMBODIMENTS

Figure 1:
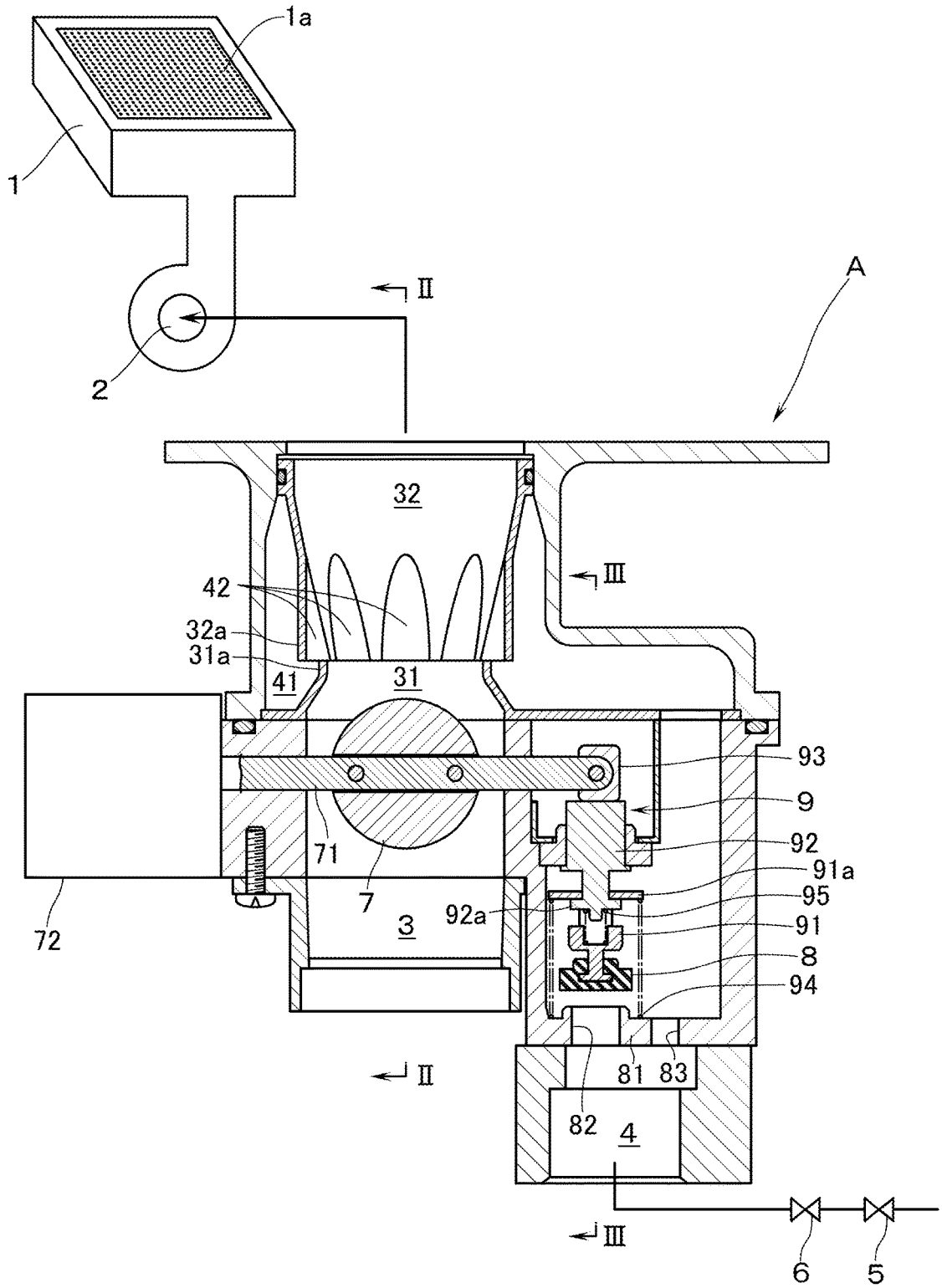
FIG. 1 is a side view, partly shown in section, showing a premixing apparatus according to an embodiment of this invention.

With reference to FIG. 1, reference numeral 1 denotes a burner comprising a totally aerated combustion burner having a combustion surface 1*a* in which a fuel-air mixture is ejected for combustion. The burner 1 has connected thereto a fan 2. By means of a premixing apparatus A according to an embodiment of this invention, a fuel gas is mixed with air so that the fuel-air mixture is supplied to the burner 1 through the fan 2.

The premixing apparatus A is provided on an upstream side of the fan 2 with an air feed passage 3, and a gas feed passage 4 for supplying a fuel gas. On an upstream side of the gas feed passage 4 there are interposed: an on-off valve 5; and a flow control valve 6 which is made up of a proportional valve or a zero governor. Further, the premixing apparatus A is provided with: an air resistance changeover means which changes over, between high and low, a flow resistance in the air feed passage 3; and a gas resistance changeover means which changes over, between high and low, a flow resistance in that part of the gas feed passage 4 which is on a downstream side of the flow control valve 6.

Figure 2:
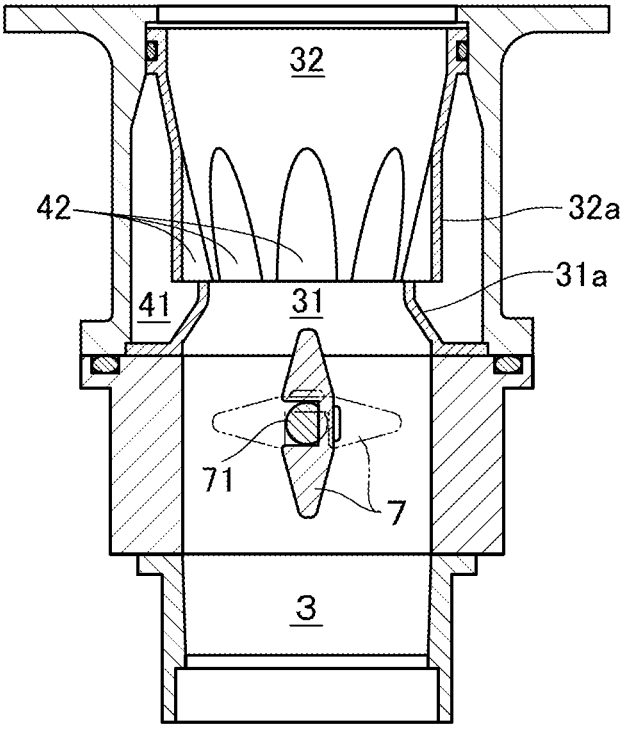
FIG. 2 is a sectional view taken along the line II-II in FIG. 1.

With reference also to FIG. 2, the air resistance changeover means is constituted by a butterfly valve 7 which is provided inside the air feed passage 3 so as to be rotatable about an axis 71 and which is made up of a disc smaller to a certain degree than the diameter of the air feed passage 3. To the axis 71 of the butterfly valve 7 is connected an actuator 72 such as a stepping motor and the like. When the required amount of combustion has fallen below a predetermined value, the butterfly valve 7 is rotated, by the operation of the actuator 72, from an open posture of being open in the longitudinal direction of the air feed passage 3 as shown in thick lines in FIGS. 1 and 2 to a closed posture of being at right angles to the longitudinal direction of the air feed passage 3 as shown in imaginary lines in FIG. 2. In the closed posture the air flows only through the clearance between the circumferential surface of the air feed passage 3 and the outer periphery of the butterfly valve 7, whereby the flow resistance in the air feed passage 3 becomes large.

The gas resistance changeover means is constituted by a changeover valve 8 which is provided in the gas feed passage 4 in a manner to be capable of being opened and closed. The changeover valve 8 is disposed so as to lie above and opposite to a valve seat 81 which is provided to cross the gas feed passage 4. The valve seat 81 has formed therein a valve hole 82 which is opened and closed by the changeover valve 8, and a bypass opening 83 which is normally left open. When the changeover valve 8 is lowered so as to be seated on the valve seat 81, the valve opening 82 is closed. There is thus attained a state in which the fuel gas flows only through the bypass opening 83, whereby the flow resistance in the gas feed passage 4 becomes large.

Figure 3:
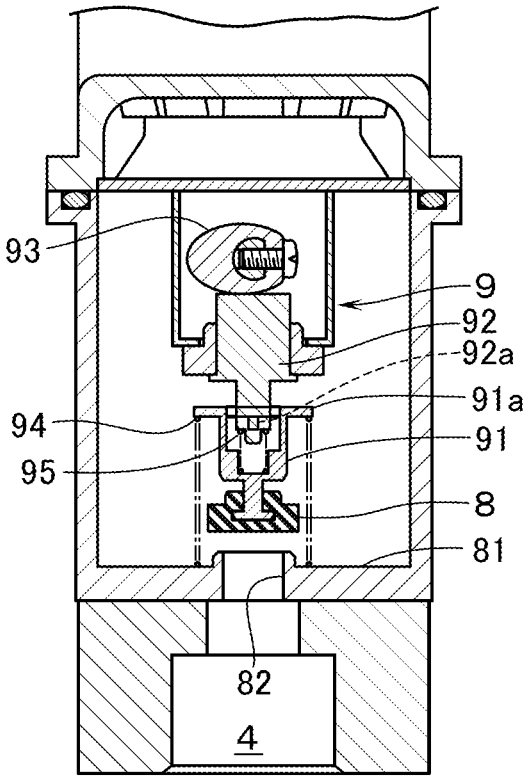
FIG. 3 is a sectional view taken along the line III-III in FIG. 1.

The changeover valve 8 is operated to be opened and closed through an interlocking mechanism 9 accompanied by the rotation of the butterfly valve 7. As shown in FIGS. 1 and 3, this interlocking mechanism 9 is made up of; a connecting element 91 which is connected to the changeover valve 8; a pushing element 92 which is disposed to lie above and opposite to the connecting element 91; a cam 93 which is attached to an end part of the shaft 71 of the butterfly valve 7 and which comes into contact with the pushing element 92; a return spring 94 which urges the changeover valve 8 through the connecting element 91 to an upward open side; and a cushion spring 95 which is interposed between the connecting element 91 and the pushing element 92 and which has a spring constant larger than that of the return spring 94. On a lower end part of the pushing element 92, there is formed a projection 92*a* which is capable of engagement with a lower surface of that spring receiving portion 91*a* for the return spring 94 which is integral with the connecting element 91.

When the butterfly valve is rotated to the side of the closed posture, the pushing element 92 moves downward by a push of the cam 93. By means of the pushing force to be transmitted through the cushion spring 95, the connecting element 91 will be moved downward against the urging force of the return spring 94. Before the butterfly valve 7 reaches the closed posture, the changeover valve 8 gets seated on the valve seat 81, thereby closing the changeover valve 8. Thereafter, during the time until the butterfly valve 7 reaches the closed posture, the cushion spring 95 will be compressed accompanied by the downward movement of the pushing element 92. When the butterfly valve 7 is rotated from the closed posture to the side of the open posture, until the butterfly valve 7 is rotated to a certain degree to the side of the open posture so that the pushing element 92 is moved upward to a position in which the projection 92*a* comes into engagement with the lower surface of the spring receiving portion 91*a*, the changeover valve 8 is maintained in the state of being closed by the urging force of the cushion spring 95.

It is to be noted here that the air flow amount does not increase so much until the butterfly valve 7 has rotated to a certain degree to the opened side. Therefore, in case the changeover valve 8 is opened before the butterfly valve 7 has rotated to a certain degree to the opened side and accordingly the fuel gas amount increases, the fuel-air mixture to be supplied to the burner 1 becomes gas-rich, whereby incomplete combustion is likely to take place. In this embodiment, on the other hand, the changeover valve 8 begins to open when the butterfly valve 7 has been rotated to a certain degree to the opened side, the fuel-air mixture to be supplied to the burner 1 will not be gas-rich, whereby incomplete combustion can be surely prevented.

In addition, the premixing apparatus A according to this embodiment is provided, in that part of the air feed passage 3 which is on the downstream side of the butterfly valve 7, with a venturi portion 31 which is coaxial with that another part of the air feed passage 3 which is provided with the butterfly valve 7, the venturi portion 31 being smaller in cross-sectional area than the cross-sectional area of said another part of the air feed passage 3. Further, there is provided an enlarged-diameter portion 32 having a gradually increasing cross sectional area from the venturi portion 31 toward the downstream side.

In addition, in that part of the gas feed passage 4 which is on the downstream side of the changeover valve 8 which is the gas resistance changeover means, there is provided a gas chamber 41 in a manner to enclose the venturi portion 31. In that part of the air feed passage 3 which is adjacent to the downstream side of the venturi portion 31, i.e., in that base end portion of the enlarged-diameter portion 32 which lies closer to the venturi portion 31, there is provided a gas suction portion 42 which sucks the fuel gas from the gas chamber 41. The gas suction portion 42 is formed by cutting and parting the peripheral wall 32*a* of the enlarged-diameter portion 32 away from the peripheral wall 31*a* of the venturi portion 31. A plurality of gas suction portions 42 are formed at an equal distance from one another in the circumferential direction. It is thus so arranged that the fuel gas can be sucked into an entire circumference of the base end portion of the enlarged-diameter portion 32.

According to this arrangement, the flow velocity of the air at the venturi portion 31 becomes high, thereby giving rise to the generation of negative pressure. Therefore, also at the time when the butterfly valve 7 is rotated to the closed posture so as to increase the air flow resistance in the air feed passage 3, the fuel gas can be sucked stably from the gas suction portion 42. Further, since the venturi portion 31 is coaxial with that another part of the air feed passage 3 which is provided with the butterfly valve 7, a negative pressure is generated uniformly over the entire circumference of the venturi portion 31. Due to this negative pressure, the fuel gas can be sucked uniformly from the gas suction portion 42 over the entire circumference of the base end portion of the enlarged-diameter portion 32. Therefore, the occurrence of fluctuations in distribution of the fuel-air ratio in the fuel-air mixture can be suppressed.

Figure 4:
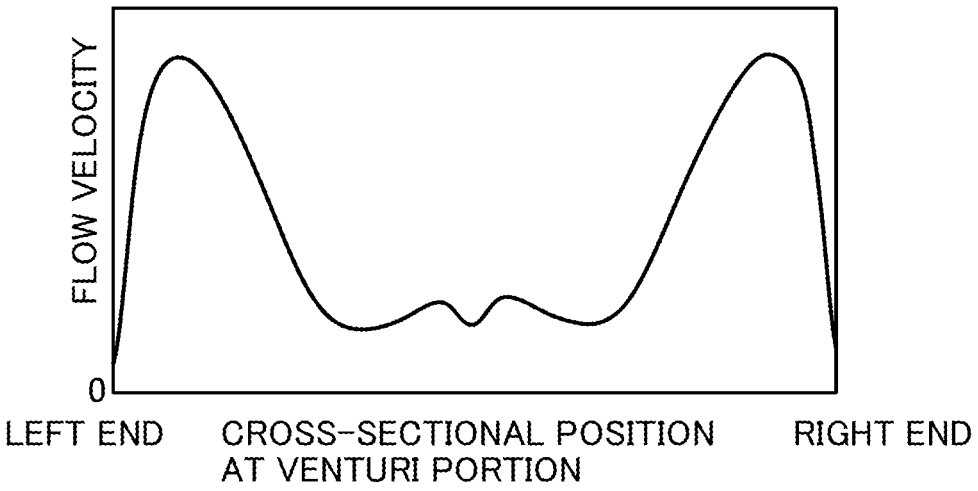
FIG. 4 is a graph showing a flow velocity distribution at the venturi portion when the butterfly valve is in the closed posture.

Further, in the embodiment of this invention, the butterfly valve 7 is formed, as shown in FIG. 2, such that the cross-sectional shape at right angles to the axis of rotation (center line of the shaft 71) is diamond. According to this arrangement, when the butterfly valve 7 is made to be in the closed posture, due to the inclination of the surface that faces the upstream side of the air feed passage of the butterfly valve 7 (the surface that faces downward as seen in FIG. 2), the air is guided to flow along the circumferential wall surface of the venturi portion 31. Therefore, as shown in FIG. 4, the air flow velocity becomes the highest in the neighborhood of the circumferential wall surface of the venturi portion 31, with the result that the negative pressure to operate on the gas suction portion 42 becomes large. As a consequence, the stability of fuel gas suction from the gas suction portion 42 is further improved when the butterfly valve 7 is moved to the closed posture, i.e., when the air flow resistance in the air feed passage 3 is increased. By the way, FIG. 4 shows an air flow velocity distribution between the left end and the right end, as seen in FIG. 2, of the venturi portion 31.

Descriptions have so far been made, with reference to the enclosed figures, of an embodiment of this invention. This invention shall, however, not be limited to the above. For example, in the above-described embodiment, the gas suction portion 42 is formed at a distance from one another in the circumferential direction. However, the gas suction portion may be formed so as to be continuous in the circumferential direction. In addition, in the above-described embodiment, the gas resistance changeover means is constituted by the changeover valve 8 that opens and closes the valve opening 82. It is also possible to constitute the gas resistance changeover means by a needle valve and the like which changes the opening degree of the valve hole.

What is claimed is:

1. A premixing apparatus for mixing a fuel gas with air to supply a fuel-air mixture to a burner through a fan, in which a downstream end of a gas feed passage having interposed therein a flow control valve for supplying the fuel gas is connected to an air feed passage on an upstream side of the fan, the premixing apparatus comprising:

an air resistance changeover means for changing over, between high and low, a flow resistance in the air feed passage, wherein the air resistance changeover means is constituted by a butterfly valve rotatable disposed in the air feed passage;

a gas resistance changeover means for changing over, between high and low, a flow resistance in such a part of the gas feed passage as is on a downstream side of the flow control valve, wherein the gas resistance changeover means is constituted by a changeover valve;

a venturi portion provided in such a part of the air feed passage as is on a downstream side of the butterfly valve, the venturi portion being coaxial with such another part of the air feed passage as is provided with the butterfly valve, the venturi portion being smaller in cross sectional area than said another part of the air feed passage;

a gas chamber provided in such a part of the gas feed passage as is on a downstream side of the gas resistance changeover means, the gas chamber enclosing an entire circumference of the venturi portion;

a gas suction portion provided to suck the fuel gas from the gas chamber into such a part of the air feed passage as is adjacent to a downstream side of the venturi portion, the gas suction portion being so constructed and arranged that the fuel gas is sucked into an entire circumference of such a part of the air feed passage as is adjacent to the downstream side of the venturi portion; and a valve seat comprising a valve opening and a bypass opening, wherein such a cross sectional shape of the butterfly valve as is at right angles to the axis of rotation thereof is a diamond, wherein, when a required amount of combustion by the burner falls below a predetermined value, the butterfly valve is configured to rotate from an open posture of being open in a longitudinal direction of the air feed passage to a closed posture of being perpendicular to the longitudinal direction of the air feed passage, wherein, when the butterfly valve is rotated into the closed posture, an annular clearance is formed between a circumferential surface of the air feed passage and an outer periphery of the butterfly valve, wherein, when the butterfly valve is rotated into the closed posture, due to an inclination of a surface of the butterfly valve, the surface facing an upstream side of the air feed passage, the air is guided to flow through a clearance along a circumferential wall surface of the venturi portion, wherein when the changeover valve is in a closed posture, the valve opening of the valve seat is closed so that a flow of the fuel is through only the bypass opening, and wherein in an interlocking manner with the rotation of the butterfly valve between the closed posture and the open posture, the changeover valve is configured to open and close.

* * * * *